428-911 SR
4/22/80 XR 4,198,707

United States Patent [19]
Haupt et al.
[11] 4,198,707
[45] Apr. 22, 1980

[54] SOFT PROTECTIVE CONSTRUCTION

[75] Inventors: Günter Haupt, Stadtbergen; Franz Fischer, Königsbrunn; Arthur Handtmann, Biberach an der Riss; Erhard Bross, Freiburg, all of Fed. Rep. of Germany

[73] Assignees: ELTEKA Kunststoff-Technik GmbH, Biberach an der Riss; EBRO Elektrotechnische Fabrik, Freiburg, both of Fed. Rep. of Germany

[21] Appl. No.: 940,209

[22] Filed: Sep. 7, 1978

[51] Int. Cl.[2] ..... F41H 1/02
[52] U.S. Cl. ..... 2/2.5; 428/911
[58] Field of Search ..... 2/2.5; 428/911

[56] References Cited

U.S. PATENT DOCUMENTS

| | | | |
|---|---|---|---|
| 1,298,618 | 3/1919 | Wloszek | 2/2.5 |
| 1,758,296 | 5/1930 | Schaumann | 2/2.5 X |
| 3,867,239 | 2/1975 | Alesi et al. | 2/2.5 X |

FOREIGN PATENT DOCUMENTS

| | | | |
|---|---|---|---|
| 631540 | 6/1936 | Fed. Rep. of Germany | 2/2.5 |
| 1013998 | 8/1957 | Fed. Rep. of Germany | 2/2.5 |
| 1196100 | 6/1965 | Fed. Rep. of Germany | 2/2.5 |
| 2642883 | 3/1978 | Fed. Rep. of Germany | 2/2.5 |

*Primary Examiner*—Louis Rimrodt
*Attorney, Agent, or Firm*—Miller & Prestia

[57] ABSTRACT

A soft protective construction for body protection, such as a bullet-proof vest or shirt is disclosed wherein a double layered bullet-stopping arrangement of mutually moveable rectangular or square protective plates is provided which plates can preferably be inserted into pockets of a carrier material. The outer layer of plates lying on the bullet impact side consists of steel and at least in portions thereof said outer plates are overlapped in scale-like fashion. The inner plate layer, which lies closer to the body than does the outer layer, is designed to absorb or largely destroy the impact energy of a striking bullet. The protective plates of the inner layer next to the body comprise a thick shock absorbing material, in particular a plastics material, such as polyamide, and said inner plates are arranged in a common plane and are joined together in a form-locked manner along the horizontally oriented, meeting plate edges by slide joints (5) and along the vertically oriented and likewise meeting plate edges by rotating joints (6, 11, 16, 17, 22, 23, 24). Preferably, the inner layer plates comprise a casting polyamide obtained by an activated anionic polymerization of monomeric laurolactam which has a Vicat B softening point of not less than about 183° C., preferably about 160° C. to 168° C.

18 Claims, 11 Drawing Figures

SOFT PROTECTIVE CONSTRUCTION

BACKGROUND OF THE INVENTION

The invention relates to a soft protective construction for body protection, such as a bullet-proof shirt or vest, with at least a double-layer bullet-proof arrangement of relatively moveable rectangular or square protective plates, which can preferably be placed in pockets in a carrier material, in which the outer layer located on the shot impact side consist of steel and at least in part zones are overlapped like scales and which in the inner layer, which may be optionally lined with padding, next to the body, are arranged to absorb and largely destroy the impact energy of a striking shot.

In a soft protective construction of this kind known from DT-PS No. 631, 540 the protective plates of the inner layer next to the body are also made of steel and like the protective plates of the outer layer are overlapped like scales along two adjacent edges. To facilitate relative movement of the protective plates, the edges of all the protective plates are provided with a flat chamfer, the plates being rivetted at an oxtruded part in the centre, which forms a bevelled seating, to a rubber impregnated layer of leather. A similar rubber impregnated layer of leather is also located on the outside of the outer layer of protective plates, while the leather layer of the inner layer of protective plates next to the body is lined with padding formed of a leather layer impregnated with rubber and reinforced with spring bands and of wadding.

With this construction, such soft protective constructions have overall a fairly high flexibility, which is important in their design as, for example, armoured vests to achieve greater comfort in wearing. However, these protective constructions no longer satisfy modern requirements in respect to adequate resistance to bullets for a still acceptable total weight, since modern types of missiles have such penetrating power that even thick steel plates, only just acceptable for comfortable wear as armoured vests, are easily penetrated.

Mainly on the grounds of reduction of weight for comparable missile resistance, modern protective constructions therefore exhibit a combination of steel plates and plastics either in rigid form or as fabric, whereby in this combination the plastics, in addition to destroying the kinetic energy of the bullet by a trapping effect also destroys the impact energy which is released by the bullet as impact load directed against the body. Thus, from DT-AS No. 1,013,998 a soft construction is known in which plates of non-magnetic manganese steel are coated on at least one side with plastics and these laminated plates are placed in individual pockets with overlapping in a carrier material of resistant textile fabric. If hereby for a comparable thickness of steel plates a comparable bullet resistance is to be achieved, then for types of shot with higher penetrating power the layer of plastics coated on the steel plates must be fairly thick. With the overlapping arrangement the construction becomes bulky, especially when according to DT-AS No. 1,196,100 to achieve still greater protection against bullets the plates are ovelapped along the vertical and the horizontal plate edges. Such protective constructions, which moreover have reduced flexibility, are therefore not serviceable from the point of view of wearability.

The object of the invention is to develop a soft protective construction of the type named at the start, which, for a total weight which is acceptable for comfortable wear, satisfies the modern requirements for protection against bullets.

SUMMARY OF THE INVENTION

This problem is solved according to the invention in that in such a protective construction the protective plates of the inner layer next to the body are made of a thick impact absorbing material, particularly of a plastics material such as polyamide, and for an arrangement in a common plane are joined along the horizontal meeting plate edges by sliding joints and along the vertical meeting edges by rotatable joints in a form-closed manner. It is thereby particulary expedient for the achievement of optimum mobility to arrange the sliding joints and the rotatable joints of the protective plates forming the inner layer next to the body essentially in alignment with the overlapping of the edges of the comparatively thin steel plates, which in this formation are of approximately the same plate size as the thicker shock absorbing material.

In a soft protective construction of this form, the thickness of the protective plates of shock absorbing material depends mainly on the type of missile, of which the penetrating force is primarily captured and braked by the steel protective plates of the outer layer. With a greater thickness of plate therefore under otherwise comparable conditions a higher resistance to penetration is achieved, whereby it is presumed that the shock absorbing material brings the bullet stopping effect which is imperative for a soft protective construction. In this respect it has been found by appropriate investigation, surprisingly, that a casting polyamide obtained by an activated anionic polymerisation of monomeric laurolactam is particularly advantageous, since with very small plate thicknesses it gave a very high protection against missiles and was extremely shock absorbing, so that the use of this casting polyamide comes especially into consideration for such soft protective constructions when the achievement of an optimum protection against missiles with the lowest possible total weight is the declared design aim. By this means it is possible to achieve directly an optimum shot protection with a plate thickness of only about 10 mm in combination with steel plates of a thickness of 2 mm.

With the above-mentioned minimum plate thickness, which can be achieved because of the special bullet impeding effect of such casting polyamide, particularly with a highest possible proportion of amorphous material, obtained by an activated anionic polymerisation of monomeric laurolactam, for this type of soft protective construction a weight saving of at least about 10% can be obtained in comparison with an arrangement in which the same casting polyamide is laminated directly onto the outer steel plates and these are overlapped like scales to a sufficient extent on all sides to give optimum protection against shot.

If another material is used to give equal shot protection, the weight saving attributable to the arrangement of the inner protective plates in a common plane is still greater, so long as the density is approximately the same, since then the plate thickness is correspondingly greater. On the other hand, by the arrangement of the inner protective plates in a common plane the doubling of plate thickness, which occurs unavoidably with scale-like overlapping, is avoided and the construction is less bulky and accordingly more comfortable to wear.

This advantage is again specially marked if for a presumed comparable protection against shots the different plate thicknesses which must be used with different materials are taken into account. With this arrangement it is also possible to make the individual protective plates of different thicknesses, so as to afford better protection to particularly impact sensitive organs by a thicker protective plate. A particular advantge is that the protective construction has a high flexibility, which gives a corresponding comfort in wear.

In respect of the form of the sliding joints and rotatable joints by which the inner protective plates are joined together, it is of the utmost importance that these do not produce weak points in the plate combination. The joints must therefore be as free as possible from gaps and so constructed that there is no reduction in plate thickness at the joints, and therefore the same resistance to penetration is maintained. Hereby a construction of the sliding joints proved particularly advantageous in which the horizontal meeting edges of adjacent plates are provided with complementary bevels, so that the oblique faces of such bevels form the actual sliding faces of that sliding joint, which in this form also permits a certain amount of rotary movement. In respect of the rotating joints on the other hand, a construction proved specially advantageous in which the corresponding vertical edges of adjacent plates are formed of complementary cylindrical faces which have the same vertical axis of rotation and which are formed convex on one edge and concave on the other. In both forms therefore there is no thinning of material at the joint and at the same time this form of joint is suitable for joining plates of different thickness, because the angle of slope of the sliding faces on the one hand and the curvature of the cylindrical faces on the other hand can be kept constant. Other possible forms, especially for the rotating joints, are covered in the individual claims.

When, in the above, a horizontal orientation is mentioned for the sliding joints and a horizontal orientation for the rotating joints, these refer to the normal conditions in wearing the soft protective construction as, for example, an armour vest. Hereby the scale-like overlapping of the outer steel plates is of little importance because of the minimal plate thickness, and it can be stated in this connection that a mutual overlapping of, for example, 2 mm is adequate to achieve a sufficient protection against a shot at these edge overlaps of the steel edges. With this relatively minimal overlap, scarcely any corresponding advantage is to be expected if the steel plates are also arranged in a common plane and joined together by comparable sliding joints and rotating joints, but if it is intended to use thicker steel plates and a greater overlap, this possibility should also be exploited. The vertical orientation of the rotating joints and the horizontal orientation of the sliding joints was, moreover, chosen from the point of view of particularly comfortable wear of such an armour vest, whereby this orientation can of course be different for wearing conditions other than normal. The construction of the joints also permits the accommodation, usual for such armour vests, of these inner protective plates in individual pockets extending over the entire body width to be protected, each accommodating a row of several protective plates joined by rotating joints, and are so arranged one above the other that the sliding joints are formed between the individual rows of plates. Thereby for the individual pockets a fastening only at the upper edge of the pocket to a common carrier material can be considered, which, as with conventional armoured vests, can be an impregnated nylon material tailored into the form of a vest, which is comfortable to wear.

In respect of comfortable wear of such an armour vest, in addition to low weight and high flexibility, it is also important that a heat build-up is not produced at the body, particularly if the armour vest is worn directly next to the skin. To prevent such a heat build-up, the soft protective construction is therefore provided, in accordance with another proposal of the invention, with an air conditioned zone next to the skin, for example by forming a back lining of padding provided with vertical ventilation channels or with a more complex system of channels in the form of a grid and therefore ensuring an adequate removal of heat. The presence of such an air conditioned zone next to the body also prevents the formation of perspiration, which occurs especially with a nylon carrier material.

If the air conditioned zone is formed by such padded lining, the usual padding of such armour vests can be omitted, at least in part, because the ventilation padding gives the soft lie of the protective plates against the body which would otherwise be obtained with padding. The material for such padding forming an air conditoned lining is chosen mainly from the point of view of skin tolerance and may comprise for example, an elastic foam material fastened in strips to a cotton material so as to produce the ventilation channels required for the air conditioning.

DRAWINGS

An example of the soft protective construction according to the invention is described below with the help of the drawings wherein:

FIG. 1. is a plan view of a double arrangement of several protective plates as made, for example, for an armour vest for insertion in single pockets, FIG. 2. is a sectional view of this arrangement taken along the line II—II in FIG. 1 in which, however, the distance between the two layers of protective plates is magnified, FIG. 3. is a corresponding sectional view taken along the line III—III in FIG. 1, and FIGS. 4 to 11. comprise various forms of the individual rotating joints and sliding joints by which the thicker protective plates of the inner layer of the protective construction of FIG. 1, next to the body, are joined together.

DETAILED DESCRIPTION

A soft protective construction for body protection is formed of a double arrangement of single rows of plates A, B and C which cover a total area sufficent to protect a part of the body thus covered. The individual protective plates in the outer layer D on the shot impact side are of steel, while the protective plates of the inner layer E next to the body are preferably made of a casting polyamide with the highest possible proportion of amorphous material, obtained by an activated anionic polymerisation of monomeric laurolactam. This casting polyamide achieves a specially great shot-arresting effect and is also highly shock absorbing, so that a correspondingly better protection is afforded which for a comparable protection against bullets under otherwise unchanged conditions with other materials can be achieved only with plate thicknesses greater than about 10 mm. This plate thickness in combination with steel plates with a thickness of 2 mm has been found completely adequate on shooting at this protective construction even with hand guns with a calibre of 0.357 Magnum KTW-steel core.

Figure 1:
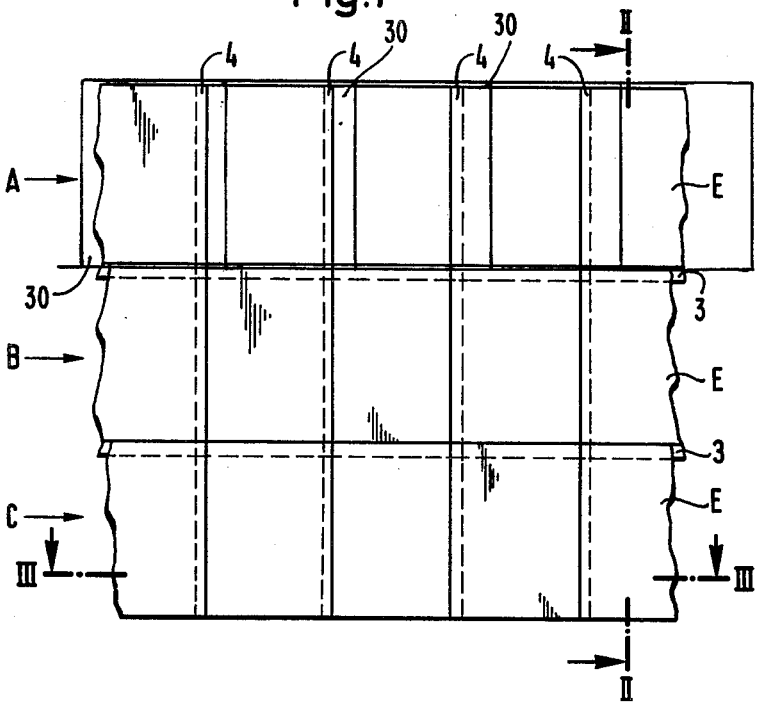
Figure 2:
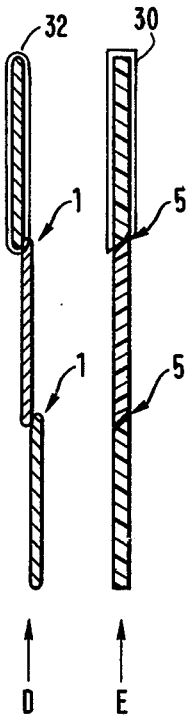
Figure 3:
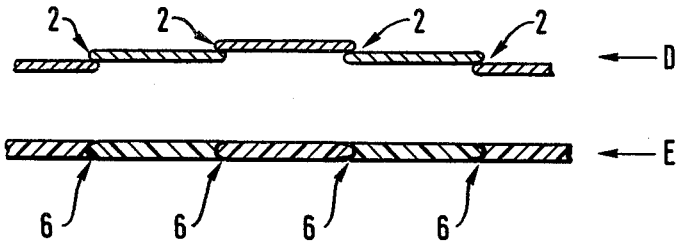
Figure 4:
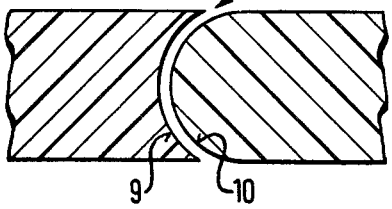

The individual steel plates of the outer layer D have a scale-like overlapped arrangement, as shown in the two cross-sections in FIGS. 2 and 3 at 1 and 2. To form the overlaps 1, the horizontal edges 3 of the steel plates which lie one above the other in the plate rows A, B and C overlap, while to form the overlaps 2, the vertical edges 4 of adjacent steel plates in these plate rows overlap. The overlapping can be achieved by accommodating the individual steel plates in individual pockets 32 which are so fastend to a carrier material so that a gapless scale armour is produced which with optimum flexibility in all directions forms the primary shot barrier.

Figure 11:
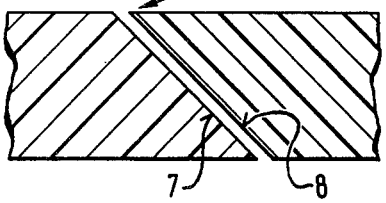

The individual protective plates of the inner layer E next to the body, which preferably consist of the abovementioned casting polyamide, do not however show overlaps comparable with the steel plates, since with the greater plate thickness of these protective plates the total thickness of this inner layer E would otherwise be too great. Instead of this, these inner protective plates are joined by horizontal sliding joints 5 and vertical rotating joints 6 which are arranged in alignment with the overlaps 1 and 2 of the steel plates. The sliding joints 5 are preferably formed by complementary wedge shaped bevels on the corresponding horizontal edges of adjacent plates, so that oblique sliding faces 7 and 8 occur at each sliding joint 5 (see FIG. 11). These sliding faces result in an almost gap-free formation of the sliding joint 5 and are designed from the viewpoint that there is to be no loss of material thickness at these sliding joints. The individual sliding joints 5 therefore have in respect of shot arresting effect precisely the same safety factor as the individual inner protective plates, whereby this safety factor also exists when the plates joined by such a sliding joint are mutually displaced along the slide plane formed by the slide faces 7 and 8. The slide plane should be directed obliquely downwards and outwards, so that the individual plates are pressed away from the body when the wearer of such a protective construction bends forward.

The individual rotating joints 6, for which various possibilities are indicated in FIGS. 4 to 10, are constructed from the same point of view of achieving the same safety factor as that of the plates. In the construction in FIG. 4 the corresponding vertical edges of adjacent plates are provided with complementary cylindrical faces 9 and 10 to form the rotating joint, the curvature thus being convex on one plate and concave on the other and giving a common axis of rotation at each rotating joint. It is irrelevant for the achievement of optimum flexibility whether the individual plates have only convex or only concave curvatures along their vertical edges with a complementary form of the corresponding edges of the adjacent plates, or whether one edge is convex and the other concave. This form of rotating joint is particularly easy to manufacture and is therefore also preferred for combination with the equally simply made slide joint with the complementary wedge shaped bevels at the corresponding horizontal edges of adjacent plates in the design shown in FIG. 11, whereby a further advantage of this combination is that with it an inner protective armour supplementing the outer scale armour as a shot obstructer can be provided in the simplest manner, in that all protective plates in the individual plate rows A, B and C are each accommodated in a pocket and these pockets are each attached along the upper edge of the pocket to a common carrier material. The pocket material 30 fits closely enough round the individual protective plates so that the interacting cylindrical surfaces 9 and 10 of the individual rotating joints 6 lie together without a gap and on the other hand the relative mobility desired for flexibility of the combination of plates is ensured. On the other hand, the fastening points of the upper edges of the pockets are so arranged that all the protective plates of this inner armour lie in a common plane. The protective construction when it is worn receives an outward bulge permitted by the slide joints 5 and the rotating joints 6, its flexibility being determined by this possibility.

Figure 5:
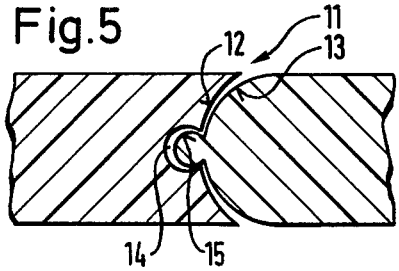

Complementary formed cylindrical faces 12 and 13 are also used in the rotating joint 11 in FIG. 5, but in the one cylindrical face 12 a central cut-out 14 is formed parallel to the axis of rotation of the rotating joint 11 and into this fits an approximately hemicylindrical ridge, of essentially complementary form, 15 on the other cylinder face 13. The cut-out 14 and the ridge 15 may be designed to form a press-stud type of snap fastening between the plates joined through the rotating joint 11, whereby it is then possible to arrange the plates with relatively greater mobility in the single pockets, because in contrast to the rotating joint 6, this snap fastening affords a force-keyed joint between the adjacent plates.

Figure 6:
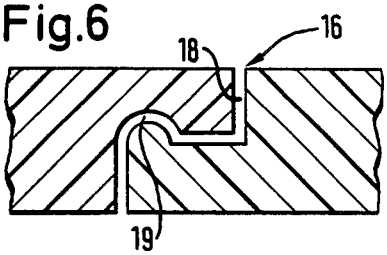
Figure 7:
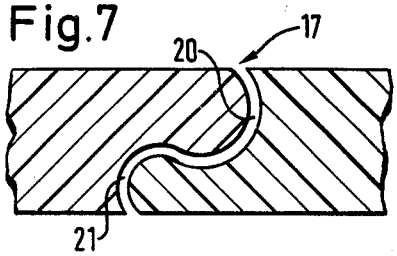
Figure 8:
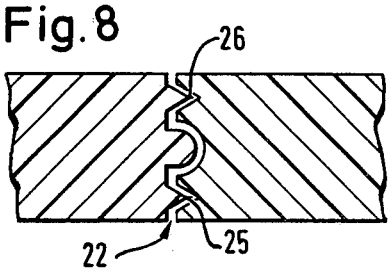
Figure 9:
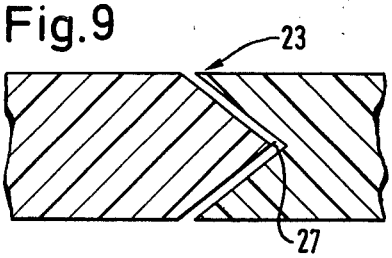
Figure 10:
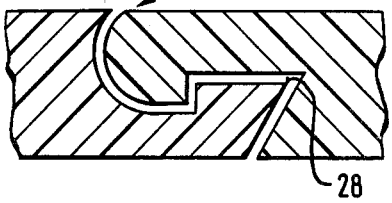

The rotating joints 16 and 17 in the forms shown in FIGS. 6 and 7 have rather an S-shaped curve of the mutually contacting surfaces at the corresponding vertical edges of adjacent plates. In the rotating joint 16 a right-angle section of straight lines 18 is combined with a curved section 19 to give this approximately S form to the contacting surfaces, while in the rotating joint 17 two sections 20 and 21 of different curvatures define this approximately S form of the complementary contacting faces. In both cases the curved sections must afford the relative rotary mobility of the adjacent plates, and this condition must also be satisfied by the rotating joints 22, 23 and 24 in FIGS. 8 to 10. In the rotating joints 22 and 23 the acute angled contact faces 25 and 26 or 27 form a kind of knife edge bearing in the vertex, to which the shape of the whole of the effective contact faces of the particular rotating joint must be matched. In the rotating joint 22 the cylindrical faces still present in the middle of the plates can also be designed to form a press stud type of snap fastening comparable with rotating joint 11, which is also true of the curved section of the interacting contact faces in the rotating joints 16, 17 and 24. All the rotating joints in the forms shown in FIGS. 5 to 10 have in common that a gap of varying size is present between the interacting contact faces, which determines the relative mobility and of which the shape is so chosen that each particular rotating joint has a form with no clear gap and no actual thinning of material.

Finally it must be pointed out that instead of an arrangement of the slide joints and rotating joints in alignment with the overlaps of the outer steel plates, a deviating arrangement may be chosen, particularly if the inner protective plates are made of a less rigid and therefore somewhat flexible material and then to achieve a comparable flexibility a larger plate size can be retained.

The square or rectangular form cited for the individual protective plates is directed towards the various parameters, such as form of the joints, achieveable protection against shots from hand guns of particular calibre, including steel-core ammunition, also protection against secondary injury, and achievable mobility of the entire plate combination of the protective construction. The protective plates may therefore also have a dished form and in particular cases may also take the form of a trapezium, modified in the limiting case to a triangle.

The mobility of the protective construction also depends on the carrier material used, for which, besides the rather unyielding nylon material, other materials, including leather, may be considered, which in particular have somewhat elastic material properties. Another possibility is to supplement or replace the previously natural air conditioned zone formed merely by ventilation channels in a padded lining with forced ventilation.

We claim:

1. Soft protective construction for body protection, such as a bullet proof vest or shirt, with at least a double-layered bullet-stopping arrangement of mutually moveable rectangular or square protective plates, which can preferably be inserted in pockets (30, 32) in a carrier material, which in the outer layer lying on the bullet impact side consist of steel and at least in part-regions are ovelapped like scales, and which in the inner layer next to the body, are designed to absorb or largely destroy the impact energy of a striking bullet, characterized in that the protective plates of the inner layer (E) next to the body consist of a thick shock absorbing material, in particular a plastics material, such as polyamide, and for arrangement in a common plane are joined together in a form-locked manner along the horizontally orientated, meeting plate edges by slide joints (5) and along the vertically orientated and likewise meeting plate edges by rotating joints (6, 11, 16, 17, 22,23,24).

2. Soft protective construction according to claim 1, characterized in that the slide joints (5) and the rotating joints (6, 11, 16, 17, 22,23, 24) are arranged essentially in alignment with the edge overlaps (1, 2) of the comparatively thin steel plates.

3. Soft protective construction according to claim 1 or 2, characterized in that the slide joints (5) are formed by complementary wedge shaped bevels (7, 8) on the corresponding horizontal meeting edges of adjacent protective plates.

4. Soft protective construction according to claim 3, characterized in that complementary wedge shaped bevels (7, 8) of the slide joint (5) are directed obliquely downwards and outwards towards the outer steel plates.

5. Soft protective construction according to claim 1 characterized in that the rotating joints (6) are formed by cylindrical faces (9, 10) of essentially complementary shape on the corresponding vertical edges of adjacent protective plates.

6. Soft protective construction according to claim 1 characterized in that the rotating joints (16, 17) are formed by contact faces of essentially complementary form of approximately S-shaped form.

7. Soft protective construction according to claim 6, characterized in that the approximately S-shaped contact surfaces of the rotating joint (16) consist of a right-angle section of straight lines (18) in combination with a curved section (19).

8. Soft protective construction according to claim 6, characterized in that the approximately S-shaped contact faces of the rotating joint (17) consist of at least two different curved sections (20, 21).

9. Soft protective construction according to claim 8, characterized in that the two curved sections (20, 21) are of different sizes.

10. Soft protective construction according to claim 1, characterized in that the rotating joints (22, 23, 24) are formed by at least one pair of acute angled contact faces interacting in the manner of a knife edge bearing in the vertex.

11. Soft protective construction according to claim 10, characterzied in that the acute angled contact faces (25, 26, 28) are combined with interacting curved contact faces.

12. Soft protective construction according to claim 1, characterized in that one of the interacting contact faces (12, 13) the rotating point (11) comprises a cut-out (14) which is formed parallel to the axis of rotation on one vertical plate edge, into which, to form a press stud type of snap fastening of the protective plates, an approximately hemicyclindrical ridge (15) formed on a vertical plate edge of a horizontally adjacent plate, is adapted to mate.

13. Soft protective construction in particular according to claim 1 characterized in that an air conditioned zone is formed on the rear side next to the body.

14. Soft protective construction according to claim 13, characterized in that the air conditioned zone is formed by a padded lining having at least vertically orientated ventilation channels.

15. Soft protective construction according to claim 14, characterized in that the padded lining is made of a foam material compatible with the skin which for a self-supporting arrangement is fastened to a cotton material.

16. Soft protective construction according to claim 13 wherein said air conditioned zone comprises a padded lining having a system of ventilation channels arranged as a grid.

17. Soft protective construction particularly according to claim 1 characterized in that the inner protective plates comprise a casting polyamide obtained by an activated anionic polymerization of monomeric laurolactam, said polyamide comprising the highest possible proportion of amorphous material.

18. Soft protective construction according to claim 17, characterized in that the casting polyamide obtained by an activated anionic polymerization of monomeric laurolactam has a Vicat B softening point of not less than about 183° C., preferably about 160° C. to 168° C.

* * * * *

UNITED STATES PATENT AND TRADEMARK OFFICE

CERTIFICATE OF CORRECTION

PATENT NO. : 4,198,707

DATED : April 22, 1980

INVENTOR(S) : Gunter Haupt

It is certified that error appears in the above-identified patent and that said Letters Patent are hereby corrected as shown below:

Col. 8, lines 25 and 26 (Claim 12) delete "one of the interacting contact faces (12, 13)"; delete "point" and insert instead --joint--.

Signed and Sealed this

*Twenty-first* Day of *October 1980*

[SEAL]

*Attest:*

SIDNEY A. DIAMOND

*Attesting Officer*

*Commissioner of Patents and Trademarks*

UNITED STATES PATENT AND TRADEMARK OFFICE

CERTIFICATE OF CORRECTION

PATENT NO. : 4, 198,707

DATED : April 22, 1980

INVENTOR(S) : Gunter Haupt et al

It is certified that error appears in the above—identified patent and that said Letters Patent is hereby corrected as shown below:

On the first page of the issued patent, kindly insert the following:

After "[22]" and before "[51]" kindly insert

--[30] Foreign Application Priority Data
Sept. 13, 1977 [DE] Fed. Rep. of Germany. 2741180 --.

Signed and Sealed this

*Eighteenth* Day of *August 1981*

[SEAL]

*Attest:*

GERALD J. MOSSINGHOFF

*Attesting Officer*

*Commissioner of Patents and Trademarks*